US008051669B2

(12) United States Patent
Imai et al.

(10) Patent No.: US 8,051,669 B2
(45) Date of Patent: Nov. 8, 2011

(54) LIQUID EVAPORATION COOLING APPARATUS

(75) Inventors: Masaaki Imai, Osaka (JP); Yoshinori Inoue, Hyogo (JP); Hiroaki Hayase, Osaka (JP)

(73) Assignee: Sasakura Engineering Co., Ltd., Osaka (JP)

( * ) Notice: Subject to any disclaimer, the term of this patent is extended or adjusted under 35 U.S.C. 154(b) by 516 days.

(21) Appl. No.: 12/086,344

(22) PCT Filed: Jan. 25, 2008

(86) PCT No.: PCT/JP2008/051038

§ 371 (c)(1),
(2), (4) Date: Jul. 18, 2008

(87) PCT Pub. No.: WO2008/114528

PCT Pub. Date: Sep. 25, 2008

(65) Prior Publication Data

US 2009/0095001 A1 Apr. 16, 2009

(30) Foreign Application Priority Data

Mar. 19, 2007 (JP) ..... 2007-070072

(51) Int. Cl.
*F25B 41/00* (2006.01)
*F25B 49/00* (2006.01)

(52) U.S. Cl. ..... 62/196.3; 62/DIG. 22

(58) Field of Classification Search ..... 62/171, 62/196.3, 259.4, 268, 304, DIG. 22
See application file for complete search history.

(56) References Cited

U.S. PATENT DOCUMENTS

| | | | | |
|---|---|---|---|---|
| 6,023,935 | A * | 2/2000 | Okazaki et al. | 62/119 |
| 6,672,099 | B1 | 1/2004 | Yoshimi et al. | |
| 6,755,043 | B2 * | 6/2004 | Jensen et al. | 62/268 |
| 2002/0088243 | A1 * | 7/2002 | Holtzapple et al. | 62/268 |
| 2010/0281903 | A1 * | 11/2010 | Okada et al. | 62/259.4 |

FOREIGN PATENT DOCUMENTS

| | | |
|---|---|---|
| JP | 2001-74322 | 3/2001 |
| JP | 2003-279178 | 10/2003 |
| JP | 2004-340492 | 12/2004 |
| JP | 2006-97989 | 4/2006 |

* cited by examiner

*Primary Examiner* — Marc Norman
(74) *Attorney, Agent, or Firm* — Jordan and Hamburg LLP

(57) ABSTRACT

In an apparatus comprising: an evaporator 1 for boiling and evaporating a cold/heat evaporable liquid under a reduced pressure; a condenser 2 for condensing vapor; a cold/heat indirect heat exchanger 6 at a load 14 side; a cooling heat exchanger 11 using the air; cold-heat circulation means 5 and 7 for circulating a cold/heat evaporable liquid in the evaporator to the cold/heat indirect heat exchanger; cooling circulation means 10 and 12 for circulating a cooling evaporable liquid in the condenser to the cooling heat exchanger; and a vapor compressor 20 provided in a vapor duct 19 extending from the evaporator to the condenser, a running cost is reduced when a temperature at the condenser side becomes lower than a temperature at the evaporator side due to a drop in air temperature, without a rise in a temperature of the cold/heat evaporable liquid. The vapor duct 19 is provided with a bypass vapor path 22 for bypassing the vapor compressor. The bypass vapor path is provided with an on-off valve 23. When a temperature at the condenser side becomes lower than a temperature at the evaporator side, the vapor compressor is shut down and the on-off valve is opened.

2 Claims, 3 Drawing Sheets

LIQUID EVAPORATION COOLING APPARATUS

TECHNICAL FIELD

The present invention relates to a cooling apparatus in which, in supplying an evaporable liquid such as water, that is, a cold/heat evaporable liquid, to a load side such as a site to be cooled with air conditioning, the cold/heat evaporable liquid is cooled to a specific temperature required at the load side, through boiling and evaporation under a reduced pressure and cooling by the air.

BACKGROUND ART

Patent Document 1 as a related art sets forth:

"An evaporation cooling apparatus including: an evaporator for boiling and evaporating a cold/heat evaporable liquid such as water under a lower pressure than an air pressure; a condenser for condensing vapor generated in the evaporator by a cooling evaporable liquid such as water; a cold/heat indirect heat exchanger installed at a load side such as a site to be cooled with air conditioning; a cooling heat exchanger using the air as a cooling source; a cold/heat circulation means for circulating a cold/heat evaporable liquid in the evaporator to the cold/heat indirect heat exchanger; and a cooling circulation means for circulating a cooling evaporable liquid in the condenser to the cooling heat exchanger, further including a vapor compressor such as a Roots compressor in a vapor duct extending from the evaporator to the condenser.

In the evaporation cooling apparatus of the related art, a cold/heat evaporable liquid is cooled by boiling and evaporation in the evaporator to a specific temperature required at the load side such as a site to be cooled with air conditioning, and the vapor generated through boiling and evaporation is guided to the condenser and then condensed by a cooling evaporable liquid using the air as a cooling source. The vapor generated in the evaporator is compressed by the vapor compressor into the condenser, whereby it is possible to cause a larger difference in temperature by a compression ratio between the evaporator and the condenser, as compared with the case where the vapor compressor is not used. Accordingly, even in the case where an air temperature as a cooling source is high, a temperature of a refrigerant evaporable liquid that is supplied to the load side can be lowered than an air temperature by a temperature difference equivalent to the compression ratio.

In the case of using a Roots compressor as the vapor compressor, for example, a compression ratio of vapor can be obtained with a temperature difference of about 15° C. As a result, it is possible to cool down reliably an evaporable liquid supplied to the load side to a low temperature of about 17 to 20° C., even if a temperature of the cooling evaporable liquid cooled by the air as a cooling source for the cooling heat exchanger, that is, a temperature of the cooling evaporable liquid supplied to the condenser reaches 32 to 35° at a maximum in the summer season or the like.

Patent Document 1: Japanese Unexamined Patent Publication No. 2006-97989

DISCLOSURE OF THE INVENTION

Problem to be Solved by the Invention

The foregoing evaporation cooling apparatus in the related art uses the air as a cooling source as stated above. A temperature of the air varies throughout the year, and in the winter season or the like where a temperature of the air is low, a temperature at the condenser side may be below a temperature of a refrigerant evaporable liquid supplied to the load side such as a site to be cooled with air conditioning, that is, a specific temperature required at the load side of the refrigerant evaporable liquid. In such a state where a temperature at the condenser side is lower than a specific temperature required at the load side, that is, than a temperature at the evaporator side, vapor generated in the evaporator can be guided to and condensed in the condenser without using the vapor compressor.

However, the foregoing evaporation cooling apparatus in the related art is configured to operate the vapor compressor between the evaporator and the condenser all the times, in either case where a rotation speed of the vapor compressor is automatically controlled by use of an inverter such that a temperature at the evaporator side is maintained at a specific temperature required at the load side, or where no automatic control is carried out. Accordingly, in the winter season or the like where a temperature at the condenser side is lower than a specific temperature at the evaporator side as mentioned above, the vapor compressor is operated unnecessarily, thereby resulting in a problem of an increasing running cost.

For reducing the running cost, the cooling apparatus may be configured to shut down the vapor compressor when a temperature at the condenser side becomes lower than a specific temperature at the evaporator side. However, in such a configuration, a flow of vapor from the evaporator to the condenser is almost blocked by shutdown of the vapor compressor, and thus the evaporator stops boiling and evaporation. Accordingly, it is impossible to continue to cool a cold/heat evaporable liquid through boiling and evaporation in the evaporator. This leads to a problematic situation where a temperature of the cold/heat evaporable liquid increases under heat load at the load side, and thus the temperature of the cold/heat evaporable liquid supplied to the load side cannot be maintained at a specific temperature required at the load side.

The present invention has a technical object to provide an evaporation cooling apparatus that eliminates these problems.

Means to Solve the Problem

The present invention discloses an evaporation cooling apparatus including: an evaporator for boiling and evaporating a cold/heat evaporable liquid under a lower pressure than a pressure of the air; a condenser liquid; a cold/heat indirect heat exchanger installed at a load side; a cooling heat exchanger using the air as a cooling source; a cold/heat circulation means for circulating a cold/heat evaporable liquid in the evaporator to the cold/heat indirect heat exchanger; and a cooling circulation means for circulating a cooling evaporable liquid in the condenser to the cooling heat exchanger, and further including a vapor compressor in a vapor duct extending from the evaporator to the condenser, wherein the vapor duct is provided with a bypass vapor path for bypassing the vapor compressor, and the bypass vapor path is provided with an on-off valve, such that the vapor compressor is shut down and the on-off valve is opened when a temperature at the condenser side becomes lower than a temperature at the evaporator side.

An opening of the on-off valve is controlled in accordance with a temperature at the condenser side or a temperature at the evaporator side, such that a degree of the opening is decreased with a drop in the temperature and is increased with a rise in the temperature.

The cooling circulation means is provided with a bypass circulation line for bypassing the cooling heat exchanger, the bypass circulation line is provided with a control valve that is opened when a temperature at the condenser side becomes lower than a temperature in the evaporator, and opening of the control valve is controlled in accordance with a temperature at the condenser side or a temperature at the evaporator side such that a degree of the opening becomes larger with a drop it in the temperature and becomes smaller with a rise in the temperature.

Advantage of the Invention

The vapor compressor is shut down when a temperature at the condenser side becomes lower than a temperature at the evaporator side due to a decreased temperature of the air in the winter season or the like, thereby reducing a running cost in a low-temperature condition.

Meanwhile, when the on-off valve in the bypass vapor path for bypassing the vapor compressor is opened, vapor generated in the evaporator passes through the bypass vapor path and flows into the condenser. Accordingly, it is possible to prevent reliably that boiling and evaporation in the evaporator are stopped due to shutdown of the vapor compressor. Further, since the cold/heat evaporable liquid can continue to be cooled through boiling and evaporation in the evaporator, it is possible to avoid reliably a rise in a temperature of the cold/heat evaporable liquid supplied from the evaporator to the load side, in excess of a specific temperature, due to shutdown of the vapor compressor.

Next, when a temperature at the condenser side or a temperature at the evaporator side drops, a degree of opening of the on-off valve becomes smaller to reduce a flow of vapor passing from the evaporator to the condenser, which prevents a temperature decrease to a lower level. Meanwhile, when a temperature at the condenser side or a temperature at the evaporator side rises, a degree of opening of the on-off valve becomes larger to increase a flow of vapor passing from the evaporator to the condenser, whereby it is possible to prevent a temperature increase to a higher level and maintain the cold/heat evaporable liquid supplied to the load side at a specific temperature.

Further, upon opening of the on-off valve, the control valve in the bypass circulation line of the cooling circulation means is opened to return part of the cooling evaporable liquid that is flowing from the condenser to the cooling heat exchanger, directly to the condenser through the bypass circulation line. This causes a rise in a temperature of the cooling evaporable liquid returning to the condenser, and thus the condenser is decreased in condensing performance by an amount of the bypassing flow.

Moreover, a degree of opening of the control valve becomes larger with a drop in temperature at the condenser side or in temperature at the evaporator side, which brings about a rise in a temperature of the cooling evaporable liquid returning directly to the condenser through the bypass circulation line. This decreases the condenser in condensing performance, thereby preventing a temperature drop to a lower level. On the other hand, when a degree of opening of the control valve becomes smaller with a rise in temperature at the condenser side or in temperature at the evaporator side, which leads to a drop in a temperature of the cooling evaporable liquid returning directly to the condenser through the bypass circulation line. This raises condenses in condensing performance, whereby it is possible to prevent a temperature rise to a higher temperature and maintain the cold/heat evaporable liquid supplied to the load side at a specific temperature.

Figure 1:
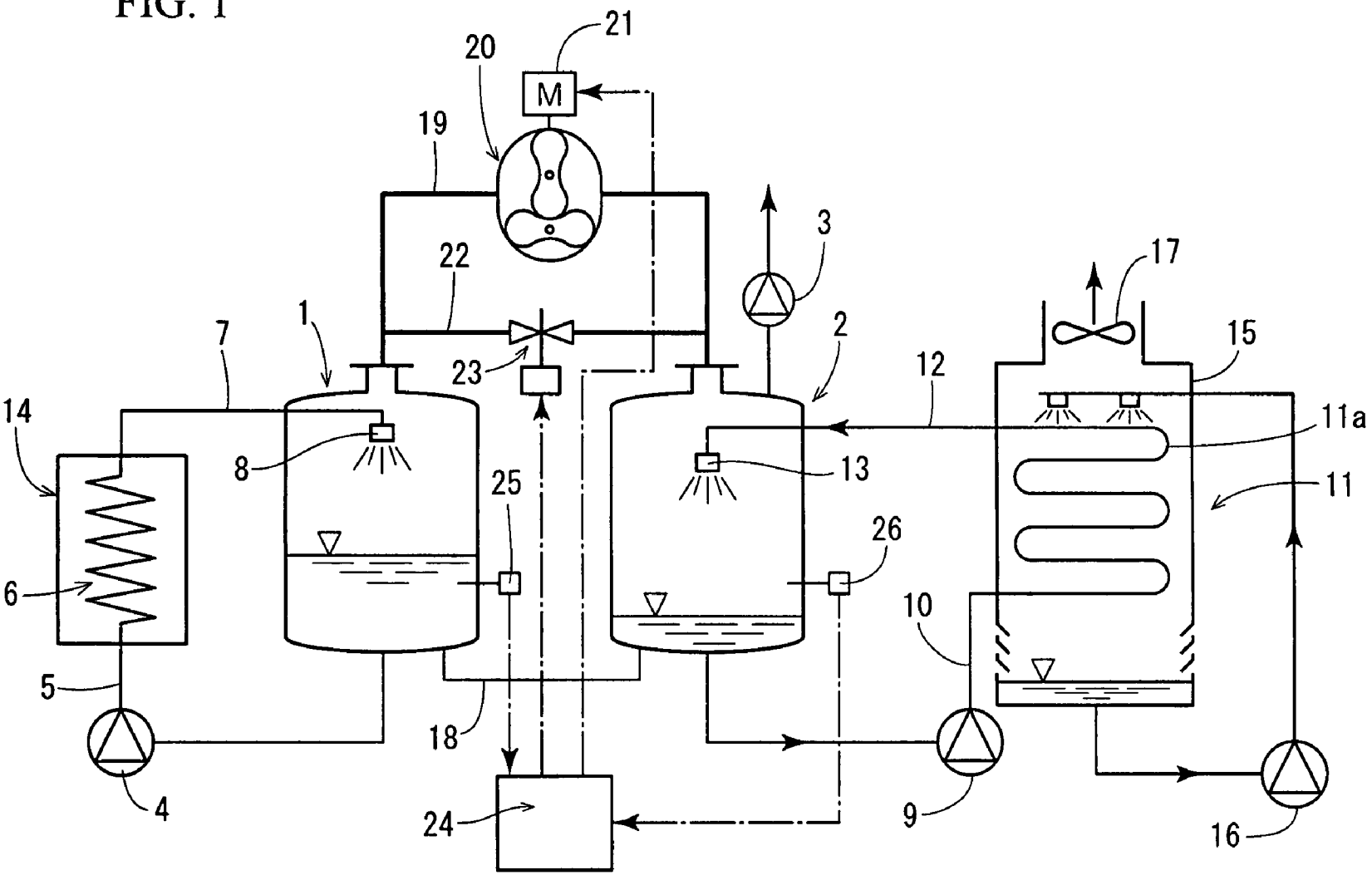
FIG. 1 is a view showing a first embodiment of the present invention.

| Description of Reference Numerals | |
|---|---|
| 1 | Evaporator |
| 2 | Condenser |
| 3 | Vacuum pump |
| 5 and 7 | Cold/heat circulation line |
| 6 | Cold/heat indirect heat exchanger |
| 10 and 12 | Cooling circulation line |
| 11 and 11' | Cooling heat exchanger |
| 14 | Load side |
| 15 and 30 | Ventilating tower |
| 19 | Vapor duct |
| 20 | Roots compressor (vapor compressor) |
| 22 | Bypass vapor path |
| 23 | On-off valve |
| 24 | Controller |
| 25 and 26 | Temperature sensor |
| 27 | Bypass circulation line |
| 28 | Control valve |
| 29 | Fluid chamber |

BEST MODE FOR CARRYING OUT THE INVENTION

Embodiments of the present invention will be described below with reference to the drawings.

FIG. 1 illustrates a first embodiment.

In FIG. 1, reference numeral 1 denotes an evaporator having an enclosed structure, and 2 a condenser having an enclosed structure likewise. The condenser 2 is connected to a vacuum generator such as a vacuum pump 3 for reducing both pressures in the condenser 2 and the evaporator 1 below an air pressure.

A cold/heat evaporable liquid such as water in the evaporator 1 is circulated in such a manner as to be drawn by a circulation pump 4, fed to a cold/heat indirect heat exchanger 6 through a cold/heat circulation line 5, and then returned to the evaporator 1 through a cold/heat circulation line 7, by spraying from a nozzle 8 at an upper portion in the evaporator 1.

In addition, a cooling evaporable liquid such as water in the condenser 2 is circulated in such a manner as to be drawn by a circulation pump 9, fed to a cooling heat exchanger 11 having an enclosed structure through a cooling circulation line 10, and then returned to the condenser 2 through a cooling circulation line 12, by spraying from a nozzle 13 at an upper portion in the condenser 2.

In this case, the cold/heat indirect heat exchanger 6 is installed at a load side 14 such as an indoor site to be cooled with air conditioning where a cold/heat evaporable liquid needs to be maintained at a specific temperature.

In the enclosed-type cooling heat exchanger 11, an enclosed-type heat transfer pipe 11*a* is disposed in an outdoor ventilating tower 15 so that a cooling evaporable liquid is circulated between an inside of the heat transfer pipe 11*a* and the condenser 2, and in the ventilating tower 15, circulating water is sprayed by the pump 16 over an outside of the heat transfer pipe 11*a* and the air is forced past by a fan 17.

The evaporator 1 and the condenser 2 are connected to each other via a communication path 18 at bottoms so that an evaporable liquid such as water passes between the two.

In addition, an upper part of the evaporator 1 is connected to an upper part of the condenser 2 via a vapor duct 19. Provided at a middle part of the vapor duct 19 is a Roots compressor 20, as an example of a vapor compressor for compressing vapor generated in the evaporator 1 into the condenser 2.

The Roots compressor 20 is driven and rotated by power transmission directly from a power source such as an electric motor 21 capable of being changed in rotation speed and an internal combustion engine, or from a power source via a belt or the like.

Further, the vapor duct 19 is provided with a bypass vapor path 22 for bypassing the Roots compressor 20, and the bypass vapor path 22 is provided with an on-off valve 23 at a middle part thereof.

Moreover, in FIG. 1, reference numeral 24 denotes a controller which is configured to control opening and closing of the bypass vapor path 22 as discussed below, with use of inputs from a temperature sensor 25 provided in the evaporator 1 or in the cold/heat circulation lines 5 and 7, and inputs from a temperature sensor 26 provided in the condenser 2 or in the cooling circulation lines 10 and 12.

More specifically, the controller 24 first controls a rotation speed of the Roots compressor 20, such that, when a temperature at the condenser 2 side (a temperature in the condenser 2 or a temperature of the cooling evaporable liquid) is equal to or more than a temperature at the evaporator side (a temperature in the evaporator or a temperature of the cold/heat evaporable liquid), the Roots compressor 20 accelerates with a rise in a temperature at the condenser 2 side or a temperature at the evaporator 1 side and decelerates with a drop in the temperature.

Next, the controller 24 shuts down the Roots compressor 20 and opens the on-off valve 32 when a temperature at the condenser 2 side becomes lower than a temperature at the evaporator 1 side. In addition, the controller 24 controls opening of the on-off valve 23 such that a degree of the opening becomes smaller with a drop in a temperature at the condenser 2 side or temperature at the evaporator 1 side and becomes larger with a rise in this temperature.

In this configuration, when a temperature at the condenser 2 side is equal to or more than a temperature at the evaporator 1 side, the Roots compressor 20 is operated and the on-off valve 23 in the bypass vapor path 22 is closed, whereby a cold/heat evaporable liquid is boiled and evaporated in the evaporator 1. In cycles, the cold/heat evaporable liquid cooled through boiling and evaporation is supplied as cold heat from the evaporator 1 to the load side 14, becomes higher in temperature when used for air conditioning, and then is returned to the evaporator 1 to be cooled again through boiling and evaporation.

Vapor generated from boiling and evaporation in the evaporator 1 is all compressed by the Roots compressor 20 and fed to the condenser 2. In the condenser 2, the vapor is cooled and condensed by a cooling evaporable liquid circulating between the condenser 2 and the cooling heat exchanger 11 using the air as a cooling source.

In this case, a temperature of a cold/heat evaporable liquid in the evaporator 1 varies with a change in temperature at the condenser 2 side, a change in a temperature of the air as a cooling source, and a decrease or increase in thermal load at the load 14 side. However, a rotation speed of the Roots compressor 20 is controlled in accordance with a temperature at the condenser 2 side or a temperature at the evaporator 1 side, such that the Roots compressor 20 accelerates with a rise in this temperature and decelerates with a drop in this temperature. Accordingly, it is possible to maintain a cold/heat evaporable liquid supplied to the load 14 at a specific temperature required at the load 14 (20° C. for air conditioning, for example).

When a temperature at the condenser 2 side becomes lower than a temperature at the evaporator 1 side with a drop in air temperature in the winter season or the like due to a change of seasons or the like, the Roots compressor 20 is shut down and the on-off valve 23 in the bypass vapor path 22 is opened to flow vapor generated in the evaporator 1 through the bypass vapor path 22 to the condenser 2, whereby it is possible to reliably prevent that boiling and evaporation in the evaporator 1 is stopped due to shutdown of the Roots compressor 20 and thus to continue cooling of a cold/heat evaporable liquid through boiling and evaporation in the evaporator 1. Accordingly, it is possible to reliably prevent a rise in a temperature of the cold/heat evaporable liquid supplied from the evaporator 1 to the load 14 in excess of a specific temperature due to shutdown of the Roots compressor 20 (such an operation involving shutdown of the Roots compressor 20 is referred to as free cooling).

In this case (free cooling), a temperature of a cold/heat evaporable liquid in the evaporator 1 varies with a temperature at the condenser 2 side, a change in a temperature of the air as a cooling source for the condenser 2, and an increase or decrease in thermal load at the load 14 side. However, the on-off valve 23 is controlled in accordance with a temperature at the condenser 2 side or a temperature at the evaporator 1 side such that a degree of opening thereof becomes smaller with a drop in this temperature and becomes larger with a rise in this temperature. Accordingly, it is possible to maintain the temperature of the cold/heat evaporable liquid supplied to the load 14 at a specific temperature required at the load 14 (20° C. for air conditioning, for example).

While the Roots compressor 20 is operated and the on-off valve 23 is closed, it is preferred to shut down the Roots compressor 20 and open the on-off valve 23 with a temperature at the compressor 2 side lower by about 5° C. or more than a temperature at the evaporator 1 side, thereby obtaining a flow of vapor in the evaporator 1 through the bypass vapor path 22 to the condenser 2. For example, if a specific temperature required at the load 14 is 20° C., the Roots compressor 20 is shutdown and the on-off valve 23 is opened when a temperature at the condenser 2 side drops to 15° C. or lower.

Figure 2:
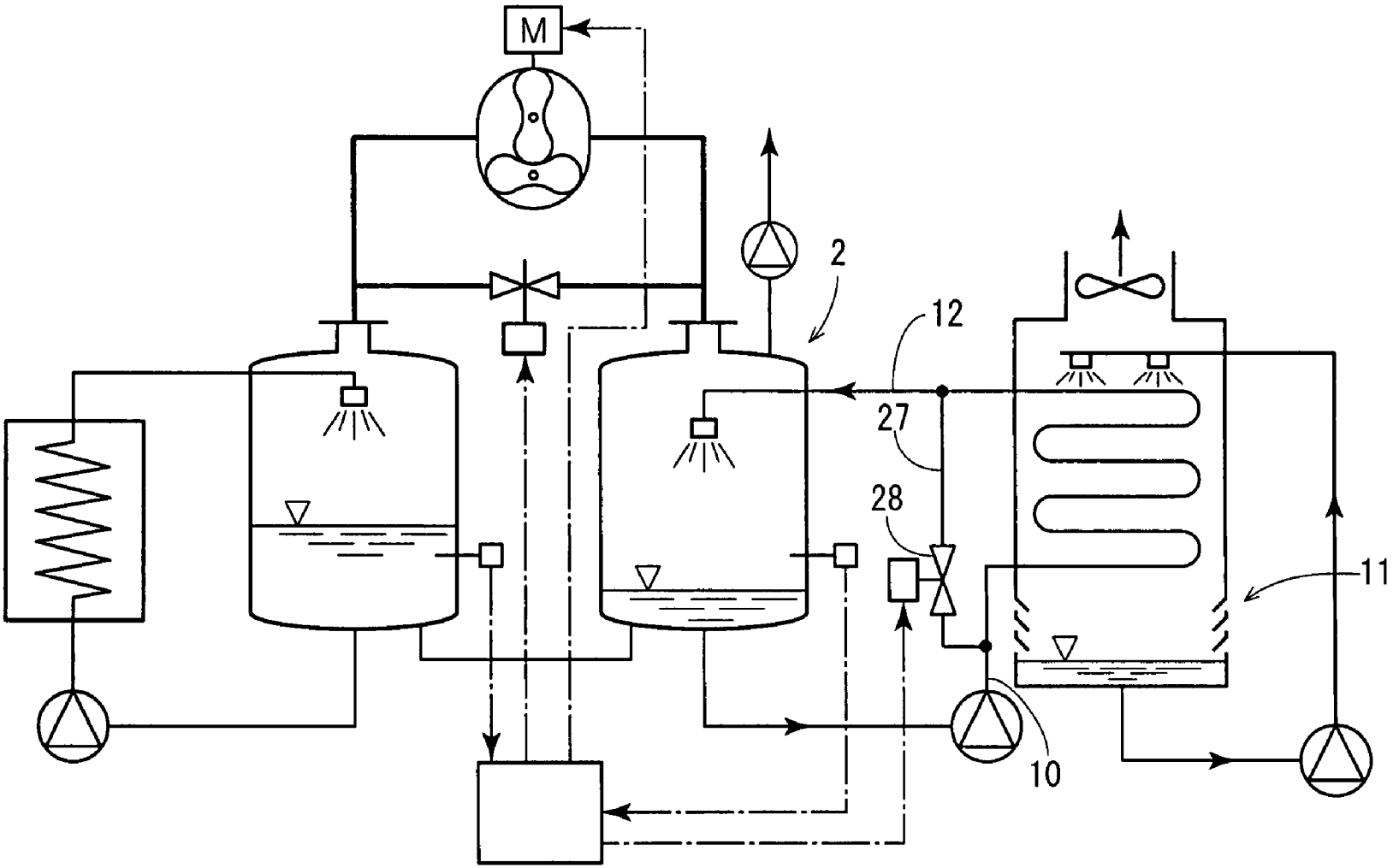
FIG. 2 is a view showing a second embodiment of the present invention.

Next, FIG. 2 illustrates a second embodiment.

In a configuration of the second embodiment, cooling circulation lines 10 and 12 for connecting the condenser 2 and the enclosed-type cooling heat exchanger 11 are provided with a bypass circulation line 27 for bypassing the cooling heat exchanger 11, the bypass circulation line 27 is provided with a control valve 28, and the control valve 28 and the on-off valve 23 are controlled by the controller 24 such that these valves are opened when a temperature at the condenser 2 side becomes lower than a temperature at the evaporator 1 side, and opening of the control valve 28 is controlled in accordance with a temperature at the condenser 2 side or a temperature at the evaporator 1 side such that a degree of the opening becomes larger with a drop in this temperature and becomes smaller with a rise in this temperature, unlike a configuration of the first embodiment in which a degree of opening of the on-off valve 23 is controlled in accordance with a temperature at the condenser 2 side or a temperature at the evaporator 1 side. In other configurations, the second embodiment is identical to the first embodiment.

According to this embodiment, when a temperature at the condenser 2 side becomes lower than a temperature at the evaporator 1 side with a drop in air temperature in the winter season or the like due to a change of seasons or the like, the on-off valve 23 is opened and at the same time the control valve 28 in the bypass circulation line 27 is opened to return part of the cooling evaporable liquid that is flowing from the condenser 2 to the cooling heat exchanger 11, directly to the condenser 2 through the bypass circulation line 27. This increases a temperature of the cooling evaporable liquid returning to the condenser 2, and thus the condenser 2 is decreased in condensing performance by an amount of a bypassing flow.

In addition, since a degree of opening of the control valve 28 becomes larger with a drop in a temperature at the condenser 2 side or a temperature at the evaporator 1 side, a temperature of the cooling evaporable liquid returning directly to the condenser 2 through the bypass circulation line 27 is raised and condensing performance of the condenser 2 is decreased, thereby preventing a temperature decrease to a lower level. On the other hand, since a degree of opening of the control valve 28 becomes smaller with a rise in a temperature at the condenser 2 side or a temperature at the evaporator 1 side, a temperature of the cooling evaporable liquid returning directly to the condenser through the bypass circulation line 27 is decreased and condensing performance of the condenser 2 is increased. Accordingly, it is possible to prevent a temperature rise to a higher level and maintain the temperature of the cold/heat evaporable liquid supplied to the load 14 side to a specific temperature.

Figure 3:
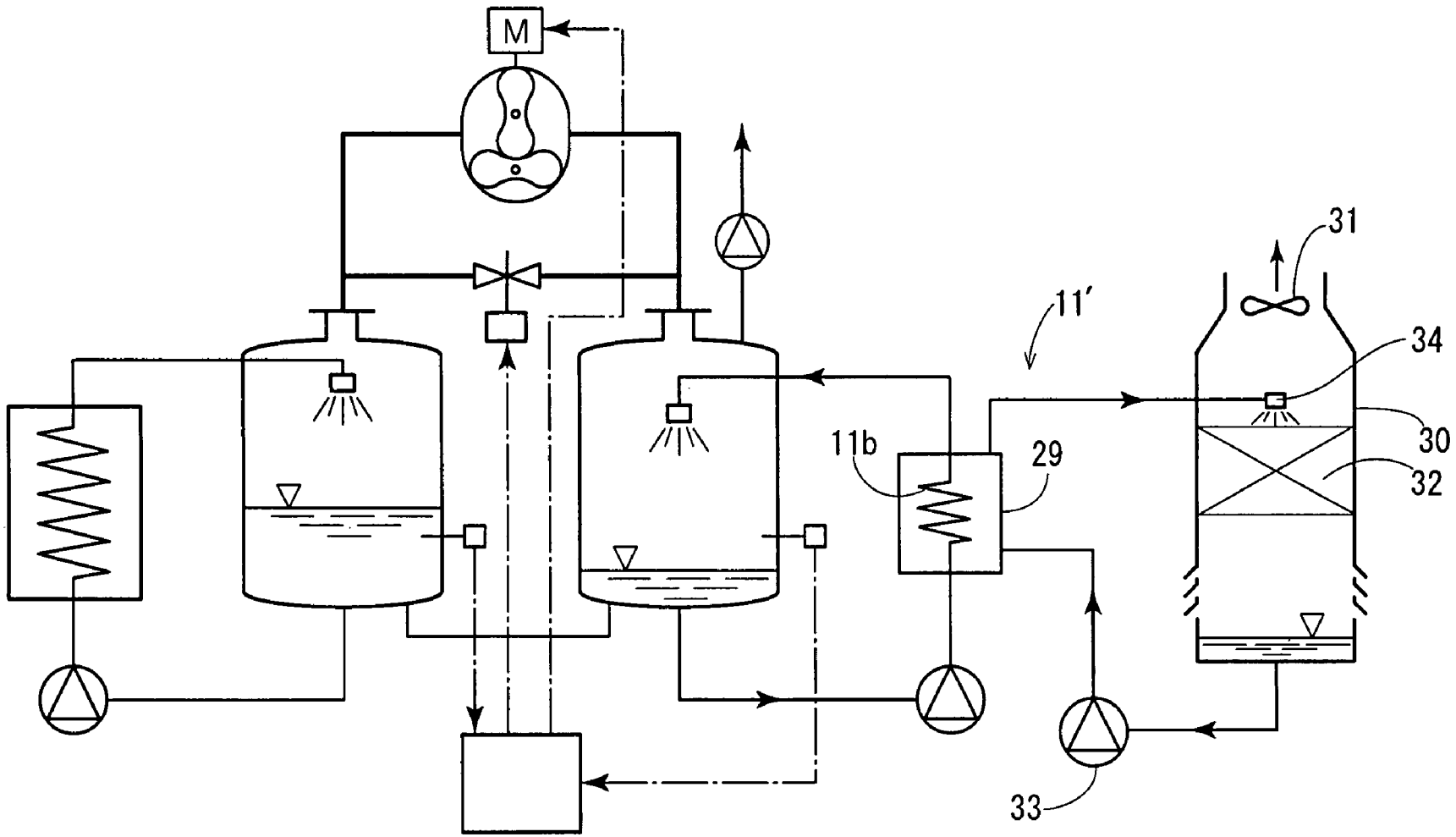
FIG. 3 is a view showing a third embodiment of the present invention.

Next, FIG. 3 illustrates a third embodiment.

In the first and second embodiments, a cooling evaporable liquid supplied to the condenser 2 is cooled in the enclosed-type cooling heat exchanger 11. In the third embodiment, an open-type cooling heat exchanger 11' is used to cool the cooling evaporable liquid. In other configurations, the third embodiment is identical to those in the first and second embodiments.

More specifically, in the open-type cooling heat exchanger 11' of the third embodiment, a heat transfer pipe 11*b* is disposed in a fluid chamber 29 containing a secondary cooling liquid so that a cooling evaporable liquid supplied to the condenser 2 circulates between an inside of the heat transfer pipe 11*b* and the condenser 2, whereby indirect heat exchange takes place between the cooling evaporable liquid supplied to the condenser 2 and the secondary cooling liquid contained in a fluid chamber 34 in the fluid chamber 29. On the other hand, a filling layer 32 such as Raschig ring is provided in a ventilating tower 30 for forced ventilation by a fan 31, the secondary cooling liquid is drawn by a circulation pump 33 out of a bottom of the ventilating tower 30 and supplied to inside the fluid chamber 29. Then, the secondary cooling liquid in the fluid chamber 29 is sprayed by a nozzle 34 over the filling layer 32 in the ventilating tower 30 and flown down the filling layer 32. Accordingly, the secondary cooling liquid is cooled through direct contact with the air in the ventilating tower 30, and the cooling evaporable liquid circulating between the condenser 2 and the inside of the heat transfer pipe 11*b* is cooled by the cooled secondary cooling liquid.

In the third embodiment, the "open-type cooling heat exchanger 11'" may be used in a state where an inside of the condenser 2 is maintained under a lower pressure than an air pressure. In addition, an antifreeze liquid may be used as the secondary cooling liquid to reliably prevent freezing of a cooling evaporable liquid circulating between the condenser 2 and the cooling heat exchanger 11" even if an air temperature falls below freezing point.

Naturally, the "cooling heat exchanger using the air as a cooling source" recited in claim 1 includes the "enclosed-type cooling heat exchanger 11" described in the foregoing first and second embodiments and also includes the "open-type cooling heat exchanger 11'" described in the foregoing third embodiment.

In addition, it is a matter of course that, similarly to the first and second embodiments, the third embodiment may be configured such that a temperature in the on-off valve 23 in the bypass vapor path 22 of the vapor duct 19 is controlled or a temperature in the control valve 28 in the bypass circulation line 27 of the cooling circulation lines 10 and 12 is controlled.

Further, in each of the foregoing embodiments, the cold/heat evaporable liquid and the cooling evaporable liquid include water as mentioned in each of the foregoing embodiments, various water solutions, and other evaporable liquids such as alcohol. In addition, it is needless to say that an anti-freezing agent, an anticorrosive agent, a rust inhibitor, or a scale inhibitor may be added as appropriate to these evaporable liquids such as water.

Moreover, the vapor compressor is not limited to the Roots compressor mentioned in each of the foregoing embodiments and may be a rotary compressor such as a variable-wing compressor or a screw-type compressor, and may also be a centrifugal (blower) compressor if a low compression ratio is acceptable.

The invention claimed is:

1. A liquid evaporation cooling apparatus comprising: an evaporator for boiling and evaporating an evaporable liquid under a lower pressure than a pressure of the air; a condenser for condensing vapor generated in the evaporator by a cooling evaporable liquid; an indirect heat exchanger installed at a load side; a cooling heat exchanger using the air as a cooling source; a circulation means for circulating an evaporable liquid in the evaporator to the indirect heat exchanger; and a cooling circulation means for circulating a cooling evaporable liquid in the condenser to the cooling heat exchanger, and further comprising a vapor compressor in a vapor duct extending from the evaporator to the condenser, wherein the vapor duct is provided with a bypass vapor path for bypassing the vapor compressor, and the bypass vapor path is provided with an on-off valve, such that the vapor compressor is shut down and the on-off valve is opened when a temperature at the condenser side becomes lower than a temperature at the evaporator side, wherein opening of the on-off valve is controlled in accordance with a temperature at the condenser side or a temperature at the evaporator side, such that a degree of the opening is decreased with a drop in the temperature and is increased with a rise in the temperature.

2. A liquid evaporation cooling apparatus comprising: an evaporator for boiling and evaporating an evaporable liquid under a lower pressure than a pressure of the air; a condenser for condensing vapor generated in the evaporator by a cooling evaporable liquid; an indirect heat exchanger installed at a load side; a cooling heat exchanger using the air as a cooling source; a circulation means for circulating an evaporable liquid in the evaporator to the indirect heat exchanger; and a cooling circulation means for circulating a cooling evaporable liquid in the condenser to the cooling heat exchanger, and further comprising a vapor compressor in a vapor duct extending from the evaporator to the condenser, wherein the vapor duct is provided with a bypass vapor path for bypassing the vapor compressor, and the bypass vapor path is provided with an on-off valve, such that the vapor compressor is shut down and the on-off valve is opened when a temperature at the condenser side becomes lower than a temperature at the evaporator side, wherein the cooling circulation means is provided with a bypass circulation line for bypassing the cooling heat exchanger, the bypass circulation line is provided with a control valve that is opened when a temperature at the condenser side becomes lower than a temperature in the evaporator, and opening of the control valve is controlled in accordance with a temperature at the condenser side or a temperature at the evaporator side such that a degree of the opening becomes larger with a drop in the temperature and becomes smaller with a rise in the temperature.

* * * * *